United States Patent [19]

Schweizer

[11] Patent Number: 4,656,952

[45] Date of Patent: Apr. 14, 1987

[54] ADJUSTABLE SHELVING SYSTEM

[76] Inventor: Martin F. Schweizer, 324 E. 84th St., Apt. 4C, New York, N.Y. 10028

[21] Appl. No.: 794,469

[22] Filed: Nov. 4, 1985

[51] Int. Cl.[4] ..... A47B 3/00

[52] U.S. Cl. ..... 108/111; 108/144; 248/188

[58] Field of Search ..... 108/111, 106, 107, 144, 108/153, 154, 110; 211/187, 190, 189, 207; 248/412, 423, 219.4, 245, 246, 188

[56] References Cited

U.S. PATENT DOCUMENTS

| | | | |
|---|---|---|---|
| 2,919,816 | 1/1960 | Maslon | 108/111 |
| 3,388,809 | 6/1968 | Irish | 211/190 |
| 3,424,111 | 1/1969 | Maslow | 108/144 |
| 3,503,524 | 3/1970 | Krummel et al. | 248/245 X |
| 3,747,965 | 7/1973 | Wing | 108/111 X |
| 3,757,705 | 9/1973 | Maslow | 108/144 |
| 3,964,810 | 6/1976 | Murphy | 108/111 X |
| 4,128,064 | 12/1978 | Chung et al. | 108/111 |
| 4,158,336 | 6/1979 | Brescia et al. | 108/111 |
| 4,318,352 | 5/1982 | Friedman et al. | 108/111 |
| 4,527,490 | 7/1985 | Tipton et al. | 108/111 |

FOREIGN PATENT DOCUMENTS 3038539 5/1981 Fed. Rep. of Germany ..... 108/111

*Primary Examiner*—Kenneth J. Dorner
*Assistant Examiner*—José V. Chen
*Attorney, Agent, or Firm*—Philip M. French

[57] ABSTRACT

This invention relates to a readily assembleable and adjustable shelving system. Briefly, it comprises vertical corner support posts; paired separable bracket members adapted to inter-engage about a respective support post to form a corner sleeve assembly; and a shelf provided with corner retainers bearing a recess revealing an inner surface complimentary of approxmately one-half of the circumference of a sleeve assembly. The posts and sleeve assemblies are adjustably positioned through a locking means comprising a coupled protrusion and depression provided on their contiguously abutting surfaces; while the shelf corner retainers and sleeve assemblies are secured through substantially longitudinal sets of extending ribs and recessed grooves wedgingly meshed on their contiguously abutting surfaces. Through this construction and alignment of elements, downward forces on the shelf are redirected radially inward through the assembly towards each respective support post so as to stabilize the shelf assembly.

14 Claims, 6 Drawing Figures

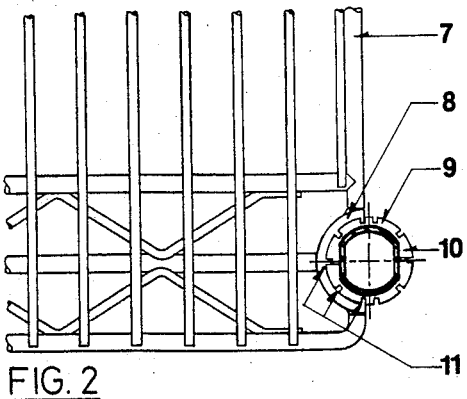
FIG. 2
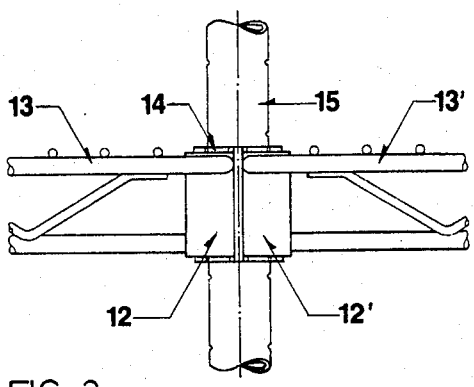
FIG. 3
FIG. 5
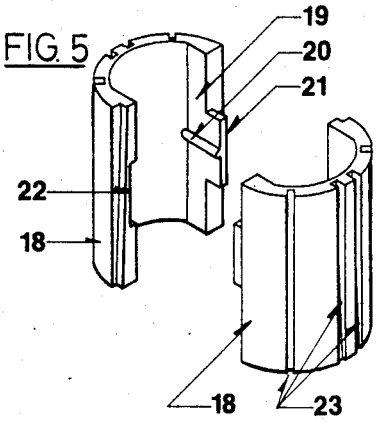
FIG. 4
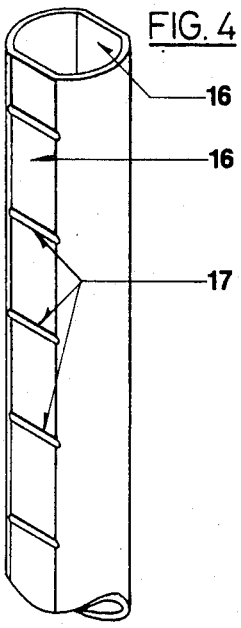
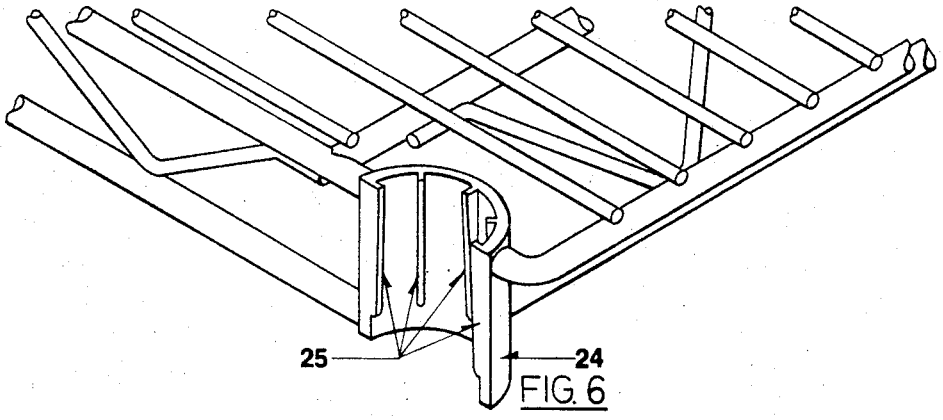
FIG. 6

ADJUSTABLE SHELVING SYSTEM

BACKGROUND OF THE INVENTION

1. Field of the Invention

This invention relates generally to adjustable shelving. More particularly the invention relates to an improved adjustable shelving system which permits ready shelf adjustment to any desired height as well as simplified assembly and disassembly of the system parts.

2. Description of the Prior Art

Adjustable shelving systems are well known. They are generally intended to be free standing without support of, for example, a wall and therefore require a certain combination of distinctive features and characteristics. Most particularly, these include a high degree of structural rigidity while retaining flexibility in the placement of shelves.

In the past, various shelving systems have been proposed which satisfactorily meet some of these criteria. A particular problem concerning the competing aspects of these criteria involves the manner in which the shelf and vertical support posts are attached. Several prior art systems utilize holes, screw fasteners and/or special tools to units these two elements. This approach has many drawbacks. Often the support poles are marred incident to relocation of shelving and, even if this problem is avoided, relocation of a given shelf within a system may become a difficult and a time consuming effort.

Certain alternative systems of the prior art which rely upon the use of an assembly intermediate the shelf and corner support posts are also known. Such systems are exemplified by those described in U.S. Pats. Nos. 3,424,111 and 3,523,503 of Louis Maslow. In these systems, interlocking bracket assembly are affixed around each corner support pole while encircling shelf retainers are placed over the poles and onto the assemblies to indirectly fix the shelf member in place on the corner support poles.

These latter systems represented a substantial advance in the art because of the simplicity with which they allow minor realignment or location of shelves. No tools or the like are required to perform this task. Notwithstanding this advance, however, they continue to exhibit drawbacks. Most particularly, a shelf must be removed upwardly from and over the entire length of the support poles because each corner shelf retainer encircles both the pole and intermediate bracket assembly. Consequently, where a lower shelf is to be removed from a multi-shelf system, each shelf above the one desired to be removed must also be disassembled to allow freedom of movement of the lower shelf.

Another serious drawback of this latter system is that it does not allow for complete flexibility in coupling shelving systems into a series composite. Thus, for example, where two separate shelving systems, each having corner support poles, are sought to be combined so as to result in a composite system composed of only three pairs of poles carrying two sets of shelves, the prior art does not allow the shelves of the two respective sets to be placed at the same height because their brackets cannot occupy the same position on the common pair of legs in the middle of the system. Moreover, because such a composite system results in having twice as many shelves on the intermediate common set of legs, it greatly complicates the difficulties of adjusting shelves after the system has been initially assembled in place. Twice as many shelves and assemblies may have to be disassembled and removed on the intermediate set of legs in order to allow adjustment or removal of a lower shelf from the system.

SUMMARY OF THE INVENTION

It is an object of the present invention to provide an adjustable shelving system having improved ease of assembly and disassembly as well as enhanced flexibility of rearrangement of shelves within the system.

It is a further object of the present invention to provide a shelving system which may be utilized in the formation of composite shelving systems containing a common pair of support poles and which, in particular, allows the alignment of shelves on either side of a common, intermediate pair of legs to the same height.

These as well as other objects of the present invention as will become clear from the description which follows are achieved through the present invention.

A readily assembled and flexible shelving system is provided comprising as a first element, vertical corner support posts. These posts may have any of the forms customary in the art. Thus, for example, they may be simple tubes or exhibit any of the cross-sectional geometric variations such as an ellipse or square as are known.

Disposed on these support posts at the respective heights at which the shelves are to be placed are corner sleeve assemblies. Each sleeve assembly is composed of a pair of separable bracket members adapted to interengage about the respective support post. Each sleeve assembly is adjustably positioned through a locking means comprising a coupled protrusion and depression provided on the contiguously abutting surfaces of the pole and bracket members (or assembly). The interior surface of the sleeve assembly is provided with either a protrusion or a coupling depression. The support post is then correspondingly provided with the remaining protrusion or depression of the couple at the height intended for placement of the shelf. Ordinarily, this means that each support post is provided with a number of spaced protrusions or depressions so that the assembly can be positioned at any desired height on the post.

Representative locking means include a simple dimple with a coupled or correspondingly shaped bump. More preferred is a transverse rib which will lockingly insert into a corresponding groove. The precise shape or location of such means does not constitute a critical aspect of the present invention and any such means known in the art may be employed.

It is desirable that the present systems be constructed in a manner to simplify orientation of each assembly such that each shelf retainer will overlap both bracket members. Preferably, this overlap occurs substantially equally over each bracket member of an assembly. This ensures the integrity of the assembly and the stability of the entire system.

One means by which this objective may be accomplished is through use of support posts which are asymmetric in cross-section. In one preferred embodiment, these posts are elliptical in crosssection. Consequently, when bracket members having complimentary inner surfaces are positioned about such a post, they can only be inter-engaged when oriented such that a shelf retainer will properly overlap each bracket member.

In another preferred embodiment, orientation of an assembly is ensured by providing each post with at least one longitudinal strip extending substantially the length of the post. Such a strip marks an eccentricity in the cross-sectional perimeter of the post. This again rotationally orients the assembly in the same manner previously described with respect to an elliptical post.

Such a strip may take any number of forms as will be obvious from the examples which follow. It may, for instance, be a simple longitudinal groove in the post surface. Similarly, it may comprise a planar surface area such as results in a rectangular flat portion on the surface of, for example, an otherwise substantially circular or tubular post. In a particularly preferred embodiment, each post exhibits a pair of such longitudinal orienting strips. They may be placed opposite each other on the cross-sectional perimeter of the post.

In a still further embodiment, the locking means for each assembly and post is located in these longitudinal, orienting strips. This puts all the orientation guides for the assemble in one place and simplifies manufacture of the system elements.

The third element acquired of the present invention is a shelf provided with corner retainers. Each retainer bears a recess revealing an inner surface complimentary of about one half the circumference of an assembly. The shelf is securely affixed to the post by means of substantially longitudinal sets of extending ribs and recessed grooves wedgingly inter-meshed on the contiguously abutting surfaces of the corner retainers and the two bracket members of a sleeve assembly. Because these meshed ribs and grooves are wedgingly oriented, they redirect any downward force placed on the shelves from its initial longitudinal direction radially inward towards a respective support post. This redirection strengthens the attachment between shelf and support posts, stabilizing the entire shelving system.

The precise manner in which these wedgingly meshed ribs and grooves are arranged is not critical. In a preferred embodiment, however, the ribs are provided in the inner surface of the retainer and the grooves on the abutting surface of the assembly. Even more preferred, the extent to which the ribs extend from the retainer decreases down the inner surface while the depth of the grooves decreases downward from the upper end of the assembly. In this arrangement, the wedging of receptor into assembly is effected in a simple manner maximizing the redirection of longitudinal force inwardly toward the support posts.

It will be apparent that the desired combination of a wedgingly secured retainer over approximately one-half of an assembly may be obtained by many other means. By way of further example only, the abutting surface of the retainers and assemblies may be frustroconical in shape. In this embodiment, these elements need exhibit only a single pair of longitudinal grooves and ribs per retainer and these may be of uniform depth and extension, respectively because a wedging effect is provided by the remainder of the assembly and retainer surfaces.

The degree of wedging is not critical to the present invention but may vary substantially as desired. Ordinarily, however it is achieved through provision of contiguously abutting surfaces of the heretofore described assembly and bracket member which are between 5° and 45°, preferably between 10° and 30°, tangent of the longitudinal support posts.

A significant aspect of the present invention lies in the fact that the corner retainers on the shelves circumscribe only one-half of the circumference of an assembly. This means that only a slight upward movement of the shelf is sufficient to lift the retainers from both the assemblies and posts. The shelf thus floats free of the remainder of the system and can be simply removed. The shelf systems of the present invention are unlike any of the prior art systems already described in that, because the corner retainers of the shelf only partially circumvent each assembly, it is unnecessary to raise the shelf the entire longitudinal and vertical distance of the support post in order to remove it from the system.

A second major improvement of this system resides in the fact that a positioned corner retainer leaves unobstructed one half of the circumference of the assembly upon which it rests. Consequently, the remaining half of the assembly may be utilized for support of another shelf affixed in series to the first shelf. Thus the present invention allows formation of a composite shelving system wherein two or more separate shelving systems are united by use of a common pair of intermediate corner support posts and corresponding assemblies. The present invention also allows such composite shelving systems to be created wherein shelves are horizontally aligned at the same heights by sharing supportive sleeve assemblies.

This latter aspect of the present invention is particularly advantageous. It results in shelving systems which are more esthetically pleasing because of their uniformity. Simultaneously, fewer parts are necessary, without any diminution of stability or function. Indeed, these characteristics of stability and function are often improved, because in the present composite systems, the assemblies on each intermediate support pole become wholly encircled by the pairs of shelf retainers which mutually rest upon them. Also, the redirection of forces becomes more uniform about each assembly and post.

In any shelf system of the present invention, whether composite or not, there will be assemblies on either end which are one-half unobstructed. In an optional embodiment, the remaining half of a sleeve assembly can also be used as a support for attaching accessories such as bumpers, towel holders, light fixtures, signs, side panels, etc. This may be accomplished by fitting an accessary with an attachment means similar to that already described respecting the corner retainer of the shelves of this invention.

BRIEF DESCRIPTION OF THE DRAWINGS

The present invention can be more readily understood and appreciated by reference to the accompanying drawings, in which:

FIG. 2 is a partial overhead view of a corner portion of adjustable shelving pursuant to the present invention;

FIG. 3 is a partial front view of a corner portion of a composite adjustable shelving system pursuant to the present invention;

FIG. 4 is a detailed isometric view of a vertical corner support post of the present invention;

FIG. 5 is a detailed isometric view of an assembly composed of a pair of separable bracket members of the present invention;

FIG. 6 is a isometric partial view of a shelf provided with a corner retainer of the present invention.

DESCRIPTION OF THE PREFERRED EMBODIMENT

Figure 1:
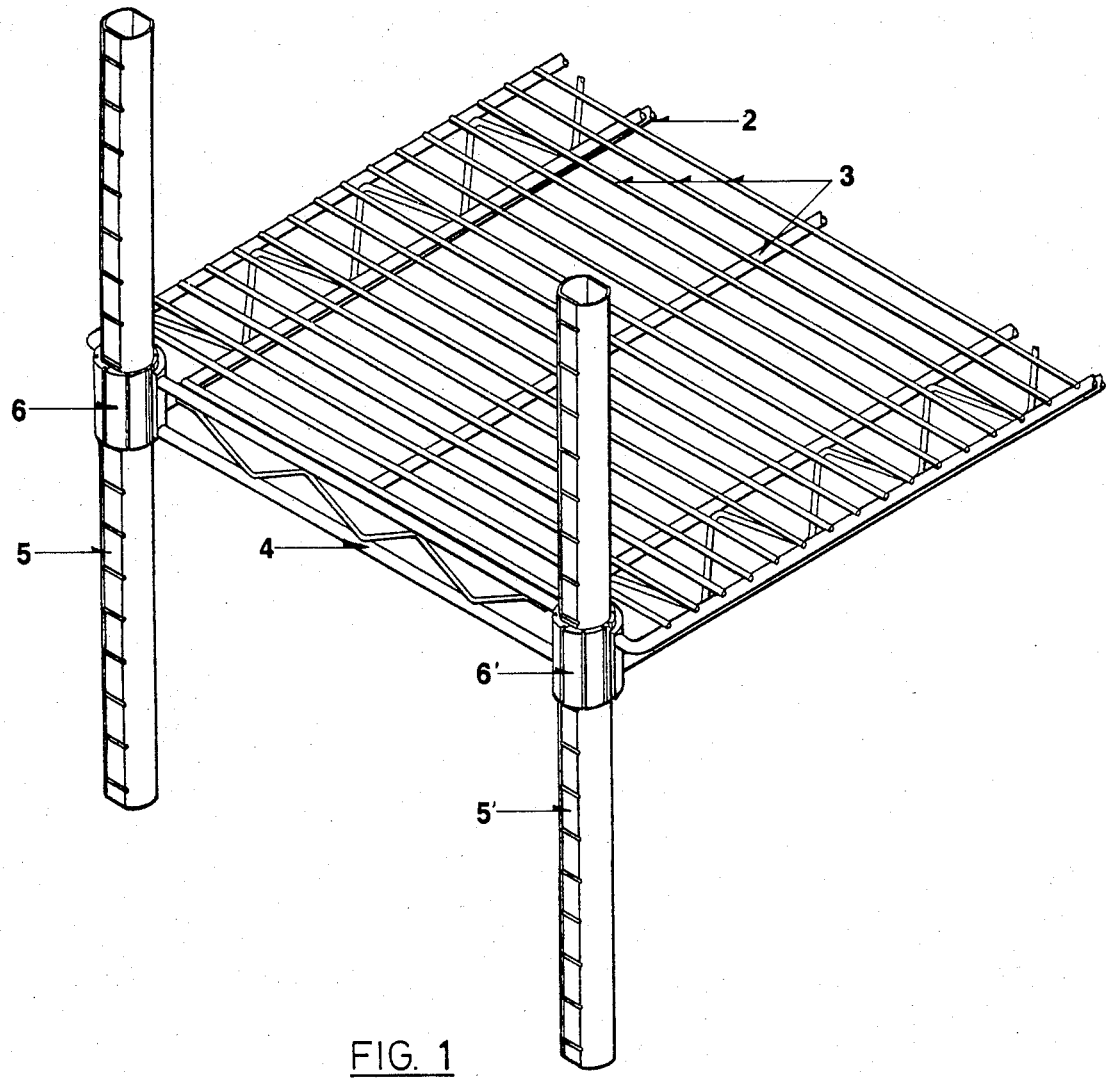
FIG. 1 is a isometric, partial view of an adjustable shelving system pursuant to the present invention.

A preferred embodiment of the present invention is shown in the accompanying drawing, FIG. 1 in which the shelf 2 is generally constructed of crisscrossed wires 3 supported along the shelf periphery by a rigid frame 4. At the two corners of the shelf, there are essentially tubular vertical support posts 5, 5'. These posts are respectively encircled at the points of attachment to the shelf by assemblies 6, 6' which are located within complimentary recesses (not shown) in the shelf frame 4 which also constitutes the shelf retainers.

As may be seen from the drawing, the frame/retainers 4 surround only about one-half of the corner support posts 5, 5'. This leaves one-half of the assemblies 6, 6' which do encircle the post available for attachment, if desired, of a second shelf (or accessaries) on the same pair of posts 5, 5' to form a composite system.

In the partial top view of FIG. 2, there is again shown a shelf portion bounded peripherally by a frame 7. At the depicted corner, the shelf contains a recess 8 in the peripheral frame 7. Within the recess is a corner assembly 9 which encircles a corner post 10. At the abutting surfaces of the frame retainer 7 and assembly 9 may be seen the meshed grooves and ribs 11 holding these elements in place.

FIG. 3 depicts a representative corner post 15 to which are attached two corner retainers 12, 12' of two separate shelves 13, 13'. Both corner retainers 12, 12' are secured to a single assembly 14 encircling the corner support post 15.

FIGS. 4–6 represent a particularly preferred combination of a vertical support post, corner sleeve assembly and shelf corner retainer suitable for use together in forming a shelving system of the present invention.

FIG. 4 depicts a preferred embodiment and construction of the corner support post. The post is essentially tubular (by which term it is meant to include a solid rod) so as to be substantially circular in a cross-section taken normal to the longitudinal axis of the post. On either side of the surface of the support post, there are longitudinal strips extending substantially the entire length of the post. These strips 16 are essentially rectangular flat areas on the surface of a post which operate as a means for orienting an assembly. In the flat surface of longitudinal strip 16 are shown a series of depressions in the form of transverse grooves 17. These grooves operate in combination with a coupled protrusion on an assembly to effect a locking means to adjustably position the height of each assembly on the post.

FIG. 5 depicts two (2) bracket members 18, 18' which together inter-engage to form a corner sleeve assembly. Referring specifically to one of the two brackets 18, the internal surface of the bracket is partially curved and partially flat. These areas are compatible with a post such as that depicted in FIG. 4 so as to allow for substantially completely contiguous and abutting surfaces when the members 18, 18' are inter-engaged to form an assembly about the post.

As shown on a flat inner surface area 19 of the member 18, there is a transverse rib 20. This rib 20 extends across to the corresponding flat portion of member 18' and forms the protrusion adapted to fit into any of the grooves 17 of a post such as that shown in FIG. 4 so as to create a locking means which positions the assembly on the post. Each member 18 also includes a tab 21 and a reciprocal insert 22. These mate with the respective tab and insert in coupled bracket member 18' so as to allow inter-engagement of the paired bracket members into a unitary sleeve assembly.

In the exterior surface of each member 18, 18' there are depicted longitudinal grooves 23. These grooves extend the length of each member and preferably decrease in depth from the top of the assembly to its bottom.

FIG. 6 depicts part of a shelf provided with a corner retainer 24. The retainer 24 has a recessed portion which, in cross-section, forms an arc of approximately 180° which is complementary with one half of the circumference or periphery of an assembly such as that already described in FIG. 5.

Within the recess of the corner retainer there are depicted a series of substantially longitudinal ribs 25. These ribs extend from the inner surface of the retainer 24 in an amount which decreases down from the top of the retainer. The extension of the ribs thus mirrors the corresponding depth of the grooves 22 already described respecting FIG. 5. This correlation of longitudinal ribs and grooves ensures optimum wedging effect when the retainer 24 is placed over the assembly bracket members 18, 18'.

It may also be seen that the result of such a wedgingly meshed series of ribs and grooves will operate to redirect force. Any weight placed on a shelf will exert a downward force through its corner retainers and longitudinal to the support poles. At the contiguously abutting surfaces of the respective retainers and assemblies, however the wedge of meshed ribs and grooves redirects that force radially inwardly toward each respective support pole.

In view of this radial redirection, a force becomes exerted against the assembly which further secures it to the support post. As a consequence, the shelving system becomes increasingly more stable as the shelves are utilized for storage purposes.

The foregoing is a description of several preferred embodiments of the invention and is given here by way of example only. The invention is not to be taken as limited to any of the specific features as herein described but comprehends all such variations thereof as come within the scope of the appended claims.

What is claimed is:

1. An adjustable shelving system comprising:

vertical corner support posts;

corner sleeve assemblies, each comprising a pair of separable bracket members inter-engaged about a respective support post;

each assembly and respective support post being adjustably positioned through a locking means comprising a coupled protrusion and depression provided on their contiguously abutting surfaces;

a shelf provided with corner retainers, each retainer having a recess revealing an inner surface complimentary of one-half the circumference of each assembly;

each retainer being secured to both bracket members of an assembly by means of substantially longitudinal sets of complimentary extending ribs and recessed grooves opposingly positioned on the inner surface of the retainer and the exterior surface of the bracket member respectively, said retainer and assembly being wedgingly meshed to redirect downward longitudinal force radially inward towards a respective support post.

2. A system according to claim 1, wherein each protrusion is a transverse rib lying in a plane normal to the longitudinal axis of the support post.

3. The shelving system of claim 2, wherein each support post surface is provided with a first longitudinal strip extending substantially its length, said strip marking an eccentricity in the cross-sectional perimeter of the post to rotationally orient the assembly.

4. The shelving system of claim 3, wherein each support post surface is provided with a second longitudinal strip opposite the first strip.

5. The shelving system of claim 4, wherein each support post is substantially circular in cross-section over the majority of its perimeter and the longitudinal orienting strips are parallel planar surface indentations in said perimeter.

6. The shelving system of claim 5, wherein the locking means for the assembly and post is located in the longitudinal orienting strips.

7. A system according to claim 2, wherein the transverse rib extends from the inner surface of one bracket member to the inner surface of the other inter-engaged member of the assembly.

8. A shelving system according to claim 7, wherein the vertical support posts are essentially tubular.

9. A shelving system according to claim 1, wherein the sleeve assembly is essentially tubular.

10. A shelving system according to claim 9, wherein the inner surface of the corner retainer forms an arch complimentary with the configuration of the assembly.

11. A shelving system according to claim 1, wherein the outer surface of the assembly is provided with longitudinal grooves commencing at the upper end of said assembly, the depth of said grooves decreasing downward from said end.

12. A shelving system according to claim 1, wherein the inner surface of the retainer is provided with longitudinal ribs and the extension of said ribs decreasing down said surface.

13. The shelving system of claim 1, wherein the cross-sectional perimeter of each support pole is elliptical.

14. A shelving system according to claim 1, wherein opposing corner retainers of two shelves are fixed to each assembly around common corner support posts to form a composite shelving system.

* * * * *